US007556480B2

(12) United States Patent
Eilertsen

(10) Patent No.: US 7,556,480 B2
(45) Date of Patent: Jul. 7, 2009

(54) FLUID PUMP

(75) Inventor: Bjørn Eilertsen, Hundvåg (NO)

(73) Assignee: EDM Engineering & Drilling Machinery AS, Stavanger (NO)

( * ) Notice: Subject to any disclaimer, the term of this patent is extended or adjusted under 35 U.S.C. 154(b) by 508 days.

(21) Appl. No.: 10/555,872

(22) PCT Filed: Apr. 21, 2004

(86) PCT No.: PCT/NO2004/000109

§ 371 (c)(1),
(2), (4) Date: Mar. 10, 2006

(87) PCT Pub. No.: WO2004/099616

PCT Pub. Date: Nov. 18, 2004

(65) Prior Publication Data

US 2006/0193737 A1 Aug. 31, 2006

(30) Foreign Application Priority Data

May 6, 2003 (NO) ..... 20032032

(51) Int. Cl.
*F04B 35/04* (2006.01)

(52) U.S. Cl. ..... 417/415; 417/534; 92/140

(58) Field of Classification Search ..... 417/534, 417/415; 123/54, 52.4, 52.6, 197.4; 74/44; 92/140, 71

See application file for complete search history.

(56) References Cited

U.S. PATENT DOCUMENTS

| | | | | |
|---|---|---|---|---|
| 2,679,826 | A * | 6/1954 | Leavell | 173/15 |
| 3,517,652 | A * | 6/1970 | Albertson | 123/65 R |
| 4,614,169 | A * | 9/1986 | Figliuzzi | 123/53.2 |
| 5,331,926 | A * | 7/1994 | Vaux et al. | 123/55.3 |
| 5,351,566 | A | 10/1994 | Barnett | |
| 5,862,781 | A * | 1/1999 | Rossle | 123/55.7 |
| 6,189,493 | B1 * | 2/2001 | Gray, Jr. | 123/52.4 |
| 6,749,408 | B1 * | 6/2004 | Eilertsen | 417/415 |
| 7,152,556 | B2 * | 12/2006 | Goltsman | 123/52.4 |
| 7,263,966 | B1 * | 9/2007 | Robison et al. | 123/197.1 |

FOREIGN PATENT DOCUMENTS

| | | |
|---|---|---|
| WO | WO 98/36192 A1 | 8/1998 |
| WO | WO 01/29415 A1 | 4/2001 |

* cited by examiner

*Primary Examiner*—Devon C Kramer
*Assistant Examiner*—Todd D Jacobs
(74) *Attorney, Agent, or Firm*—Sughure Mion, PLLC

(57) ABSTRACT

A fluid pump comprising a plurality of piston cylinders (1, 2, 3, 4), wherein each individual cylinder has a piston rod (5, 6, 7, 8) with a piston (9, 10, 11, 12) arranged in the cylinder and a valve housing (13, 14, 15, 16) mounted at the end of the cylinder opposite the piston rod, and a drive arrangement for the piston rods, said drive arrangement comprising two main gearwheels (17, 18) which mesh and rotate in opposite directions. The present fluid pump is characterized in that the reciprocating motion of the piston rods (5, 6, 7, 8), which extend in pairs in opposite directions, is effected with the aid of two beams (19, 20) that are fixed to the end of the respective pair of piston rods opposite the pistons (9, 10, 11, 12), and which extend at right angles relative to the piston rods, and that the beams are connected to the main gearwheels (17 18) by shaft pins (21, 22, 22, 23) which move in pairs in guides (24) provided in the longitudinal direction of the respective beam. The guide (24) may extend in the shape of a sine curve.

7 Claims, 4 Drawing Sheets

FLUID PUMP

This application is 371 of PCT/NO2004/000109, filed Apr. 21, 2004; the disclosure of which is incorporated herein by reference.

The present invention relates to a fluid pump comprising a plurality of piston cylinders, wherein each individual cylinder has a piston rod with a piston arranged in the cylinder and a valve housing mounted at the end of the cylinder opposite the piston rod, and a drive arrangement for the piston rods, said drive arrangement comprising two main gearwheels which mesh and rotate in opposite directions.

One example of such a fluid pump is taught in WO-$A_1$ 01/29415. However, in this fluid pump the piston rods are driven by a rack located between two pairs of main gearwheels, which moves the associated piston rods back and forth as the main gearwheels move.

The main object of the present invention is to provide a fluid pump which, unlike the previously known fluid pumps, provides constant volume and pressure from the pump, dependent only upon the speed of the pump. This object is achieved according to the invention in that the reciprocating motion of the piston rods, which extend in pairs in opposite directions, is effected with the aid of two beams which are fixed to the end of the respective pair of piston rods opposite the pistons, and which extend at right angles to the piston rods, and that the beams are connected to the main gearwheels by shaft pins which move in pairs in guides provided in the longitudinal direction of the respective beam. The guide provided in the respective beam may extend in the form of a sine curve. Other advantageous features of the invention will be understood from the dependent patent claims.

The fluid pump thus obtained is one in which the problem of compressive pulses from the piston cylinders is solved. It should be pointed out in particular that the resultant of the piston speeds is constant, so that the flow in the fluid pump is constant. Other advantages of the invention are that the fluid pump can be made far more compact and thus weigh less, i.e., the weight is reduced by about 50%. In addition, the stroke length can be increased substantially, about 100%, which gives both a longer service life for the valves and considerably greater volumetric efficiency.

The invention will now be described in more detail with reference to preferred embodiments shown in the attached drawings, wherein.

Figure 1:
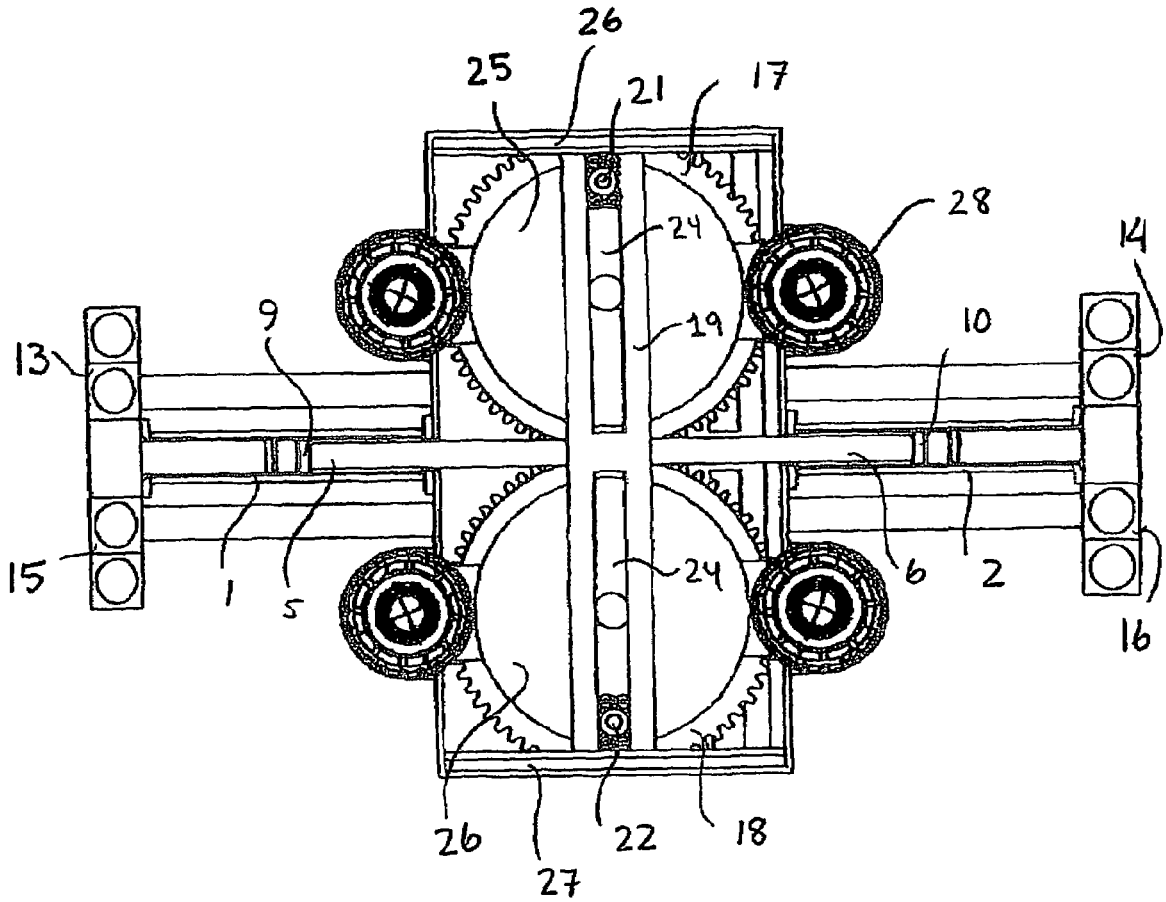
FIG. 1 is a horizontal view through a fluid pump according to one embodiment of the invention.
Figure 2:
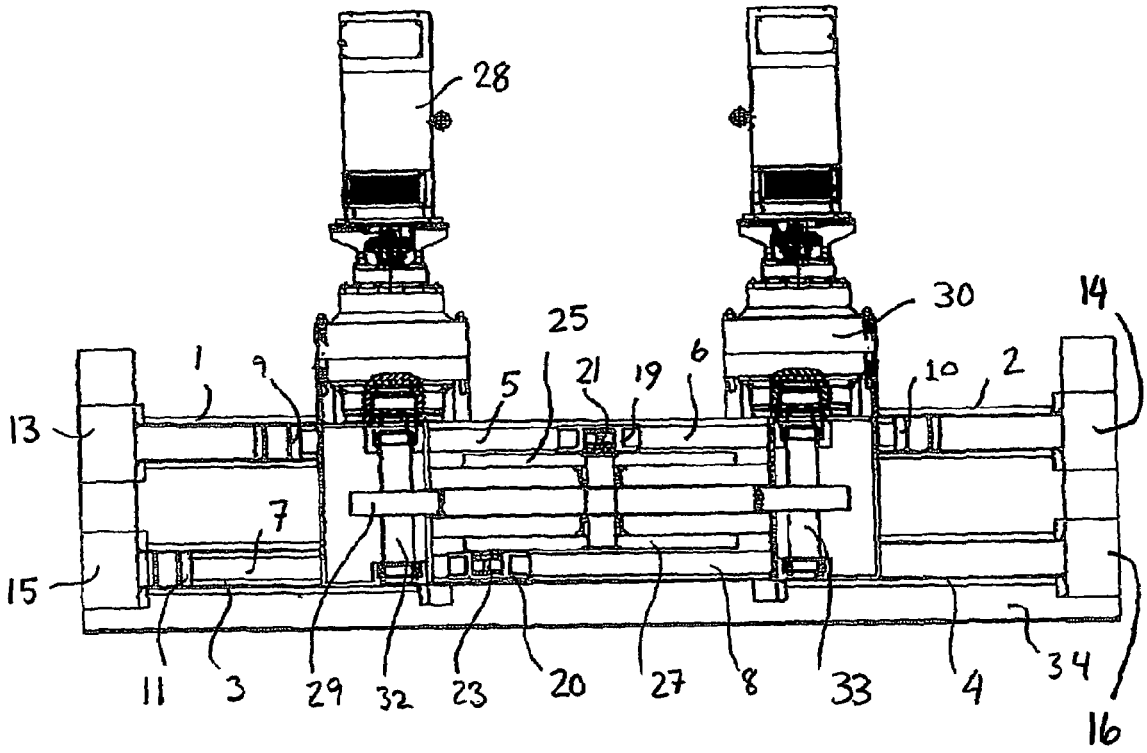
FIG. 2 is a vertical view, partly in section, through the fluid pump parallel to the piston rods therein.
Figure 3:
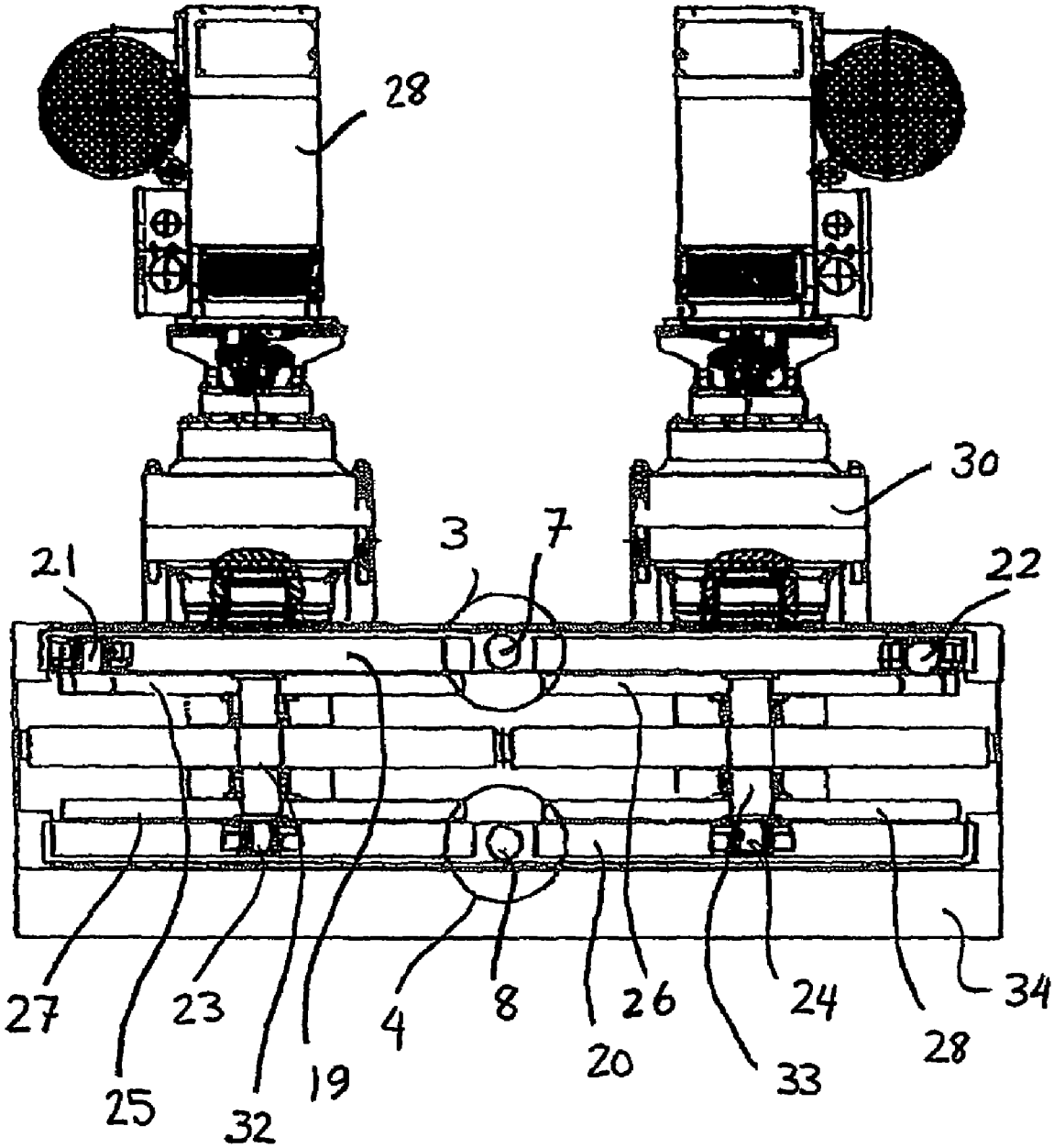
FIG. 3 is a vertical view, partly in section, through the fluid pump transverse to the piston rods.

The present fluid pump comprises a plurality of piston cylinders 1, 2, 3, 4, four in the illustrated embodiment. Each individual cylinder is equipped with a piston rod 5, 6, 7, 8 which has a piston 9, 10, 11, 12 arranged in the cylinder, and a valve housing 13, 14, 15, 16 mounted at the end of the cylinder opposite the piston rod. Each individual valve housing also has a primary valve (not shown). The components of the fluid pump mentioned above are of a conventional type and may of course include other necessary equipment which will not be described in detail, for example, for the supply of the fluid to be pumped.

The illustrated drive arrangement for the piston rods, which by means of the pistons causes the fluid to be drawn in and forced out of the cylinders, comprises two main gearwheels 17, 18 which mesh and rotate in opposite directions. Furthermore, the main gearwheels are driven by a plurality of motors 28, for example, electric motors, which are equipped with a least one gearwheel 29 for rotation of the main gearwheels and a suitable gearbox between the motor and the gearwheel. In the illustrated embodiment two motors are provided in connection with the respective main gearwheel, but the number may of course be varied. It may, for example, be limited to just one motor. Otherwise, the main gearwheels are supported by their respective shafts 32, 33, which are connected to a suitable supporting frame 34 for the fluid pump.

The actual reciprocating motion of the piston rods, which extend in pairs in opposite directions, is effected with the aid of two beams 19, 20 which are positioned above and below the main gearwheels, respectively. To be more precise, this motion is effected in that the ends of the respective pair of piston rods opposite the pistons are fixed to the associated beam, which extends at right angles to the piston rods. Furthermore, the beams are connected to the main gearwheels by shaft pins 21, 22, 23, 24, which move in pairs in pin guides 24 provided in the longitudinal direction of the respective beam. Thus, when the main gearwheels rotate, the beams will move back and forth, above and below the gearwheels respectively, in a direction transverse to the piston rods, so as to move the respective pair of piston rods correspondingly. Optimum effect in the fluid pump is achieved by the shaft pins 21, 22 above the main gearwheels being offset through 90° along the circular arc relative to the shaft pins 23, 24 below the main gearwheels.

The pin guide 24 may, for example, be in the form of two open grooves provided along the central axis of the respective beam 19, 20. The beam ends move parallel to the piston rods in two pairs of beam guides 26, 27 provided in connection with the fluid pump supporting frame. Each individual shaft pin, which has rollers and a bearing, is secured to a ring 25, 26, 27, 28 that is provided above or below the respective main gearwheel 17, 18 and attached thereto in a suitable manner.

Figure 4:
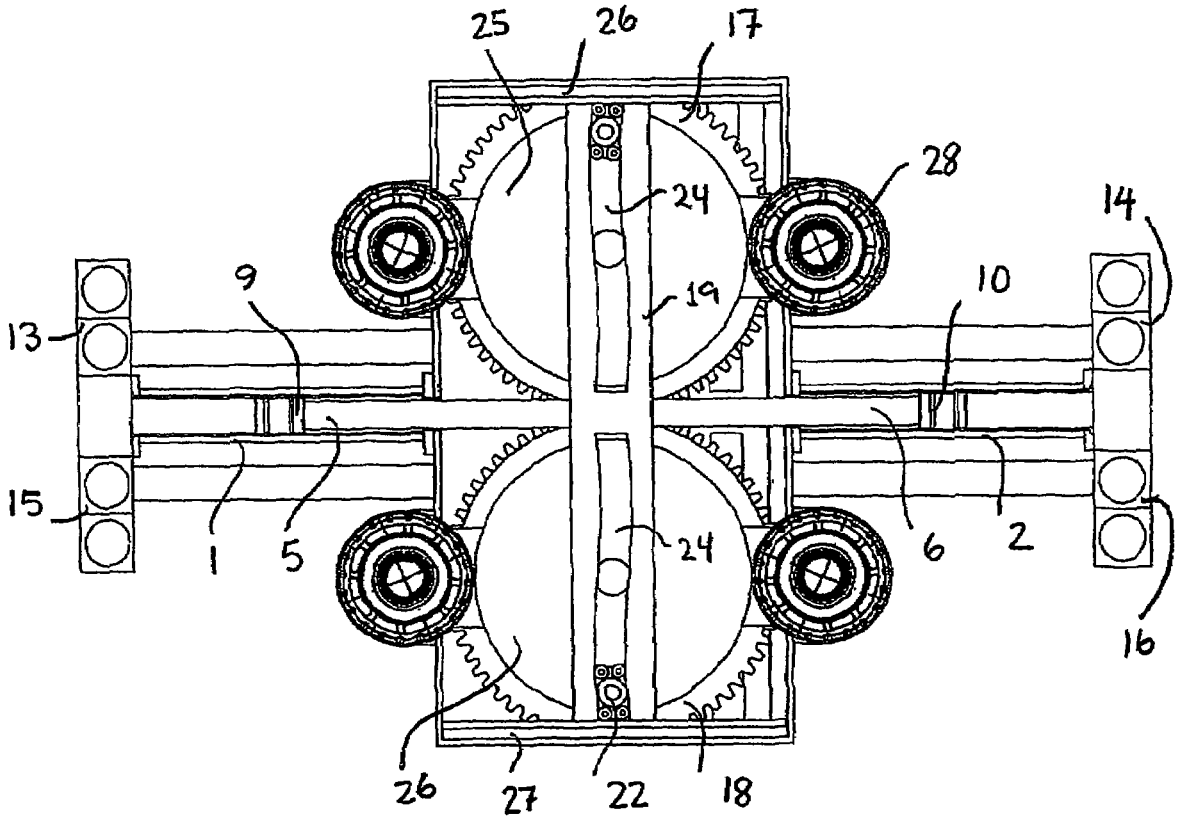
FIG. 4 is a horizontal view through a fluid pump according to an alternative embodiment of the invention.

An alternative embodiment of the invention is shown in FIG. 4. This alternative embodiment is largely identical with the embodiment described above, except that the pin guide 24 in the respective beam 19, 20 extends in the form of a sine curve. As mentioned above, this special design of the pin guide effectively helps to ensure that the resultant piston speed is constant and that as a result constant flow is obtained in the fluid pump.

The invention claimed is:

1. A fluid pump comprising a plurality of piston cylinders, wherein each individual cylinder has a piston rod with a piston arranged in the cylinder and a valve housing mounted at the end of the cylinder opposite the piston rod, and a drive arrangement for the piston rods, said drive arrangement comprising two main gearwheels which mesh and rotate in opposite directions, wherein the reciprocating motion of the piston rods, which extend in pairs in opposite directions, is effected with the aid of two beams that are fixed to the end of the respective pair of piston rods opposite the pistons and which extend at right angles relative to the piston rods, and that the beams are connected to the main gearwheels by shaft pins which move in pairs in a pin guide provided in the longitudinal direction of the respective beam and extending in the form of a sine curve to move the pistons at a constant speed to provide constant flow from the fluid pump.

2. A fluid pump according to claim 1, wherein each individual shaft pin which has rollers and a bearing, is secured to a ring located respectively above and below the respective main gearwheel.

3. A fluid pump according to claim 2, wherein the shaft pins mounted on the rings above the main gearwheels are offset through 90° along the circumference of the rings relative to the shaft pins mounted below the main gearwheels.

4. A fluid pump according to claim 1, wherein the beams move in beam guides that extend parallel to the piston rods, and that are located at respective ends of the beams.

5. A fluid pump according to claim 1, wherein the main gearwheels are driven by a plurality of motors connected to at least one gearwheel.

6. A fluid pump according to claim 5, wherein a gearbox is arranged between the motors and the gearwheel.

7. A fluid pump according to claim 1, the sine curve of the pin guides mounted above the main gearwheel are formed as formed as mirror images of one another and the sine curve of the pin guides mounted below the main gearwheel are formed as mirror images of one another.

* * * * *